US005492248A

United States Patent [19]

Ortner

[11] Patent Number: 5,492,248

[45] Date of Patent: Feb. 20, 1996

[54] PERFUME DISPENSER

[76] Inventor: Georg Ortner, Lubecker Str. 13, Koln, Germany

[21] Appl. No.: 157,209

[22] PCT Filed: Jun. 12, 1992

[86] PCT No.: PCT/EP92/01322

§ 371 Date: Jul. 22, 1994

§ 102(e) Date: Jul. 22, 1994

[87] PCT Pub. No.: WO92/22228

PCT Pub. Date: Dec. 23, 1992

[30] Foreign Application Priority Data

Jun. 12, 1991 [DE] Germany ..... 9107249 U

[51] Int. Cl.[6] ..... B67D 5/46

[52] U.S. Cl. ..... 222/78; 222/182; 222/321.1

[58] Field of Search ..... 222/78, 182, 321

[56] References Cited

U.S. PATENT DOCUMENTS

| | | | |
|---|---|---|---|
| 1,880,373 | 10/1932 | Christie . | |
| 3,078,497 | 2/1963 | Micallef . | |
| 3,331,559 | 7/1967 | Fedit | 222/321 |
| 3,482,739 | 12/1969 | Laas | 222/182 |
| 3,830,404 | 8/1974 | Frazer | 222/78 |
| 4,174,890 | 11/1979 | Nozawa et al. | 222/321 |
| 4,228,931 | 10/1980 | Ruscitti et al. | 222/321 |
| 4,284,211 | 8/1981 | Meshberg | 222/182 |
| 4,305,530 | 12/1981 | Nozawa | 222/321 |
| 4,607,765 | 8/1986 | Ruscitti | 222/321 |
| 4,952,090 | 8/1990 | Richardson | 401/209 |
| 5,102,018 | 4/1992 | William et al. | 222/321 |

FOREIGN PATENT DOCUMENTS

| | | |
|---|---|---|
| 8203321 | 9/1983 | France . |
| 88069729 | 6/1988 | Germany . |
| 706314 | 3/1954 | United Kingdom . |
| 2206542 | 11/1989 | United Kingdom . |
| 9007430 | 7/1990 | WIPO . |

*Primary Examiner*—Andres Kashnikow
*Assistant Examiner*—Kenneth Bomberg
*Attorney, Agent, or Firm*—Helfgott & Karas

[57] ABSTRACT

A perfume dispenser has a cylindrical shape similar to a pencil. A clip at the covering cap is broad and suitable for affixing advertising or jewelry, and may be slipped over the edge of a pocket, from which only the clip protrudes. The perfume dispenser has a delivery device including a pump, small sponge or a roll-on mechanism, which attaches to a glass cylinder. The covering cap is fastened by slipping it onto the perfume container, and a locking connection is provided between the cap and the perfume container. To compensate for tolerances, the covering cap can connect onto a metal mounting of the delivery device, for example, onto a screw cap. Alternatively, in a plug-in connection, the covering cap is provided with a slit in the edge region of a plug-in opening, or the covering cap may include a metal outer sleeve and an elastically deformable plastic inner sleeve. To improve seating of the cap, the inner sleeve includes ribs, which protrude inwards, extending in the longitudinal direction and having elastic properties.

11 Claims, 2 Drawing Sheets

Figure 6:
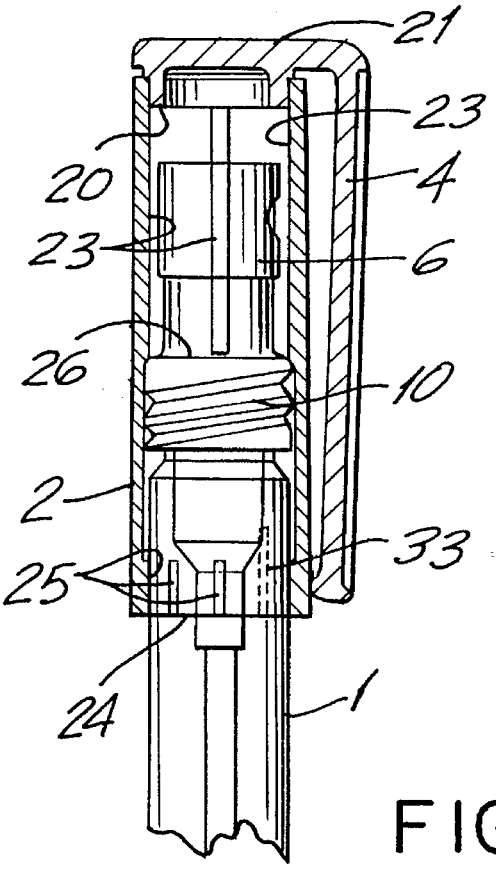

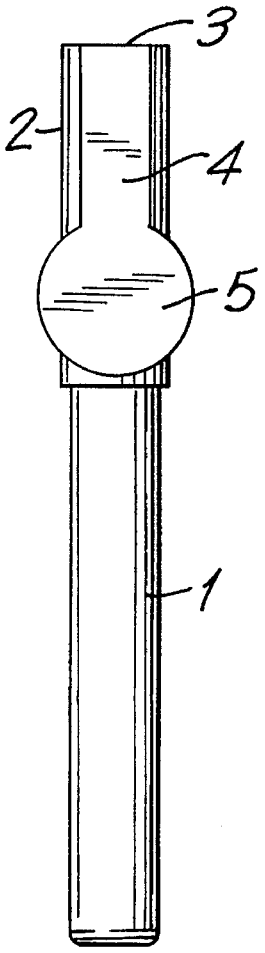
FIG. 1
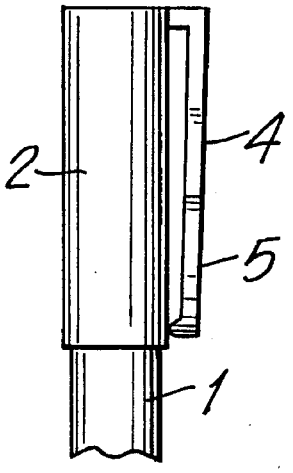
FIG. 1a
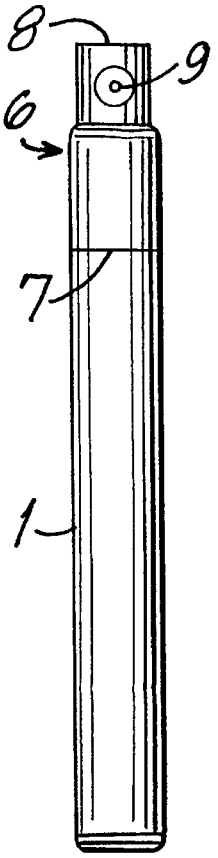
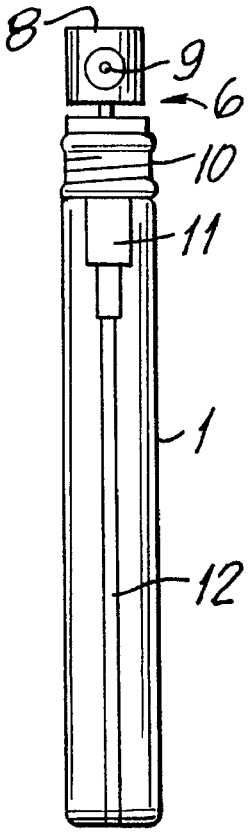
FIG. 2 FIG. 3
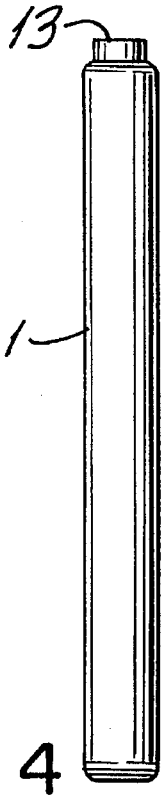
FIG. 4
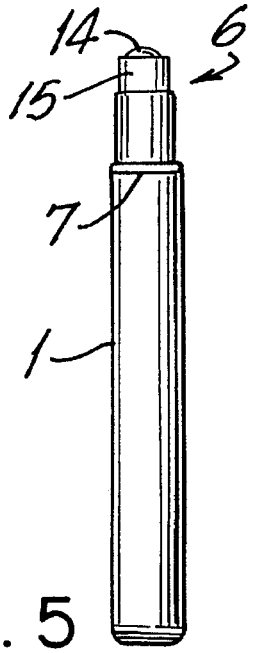
FIG. 5

PERFUME DISPENSER

The present invention relates to a perfume dispenser. Various developments of perfume dispensers are known. In general, they have a perfume container produced from glass, mostly in the form of a small bottle. For delivering the perfume, the container either has a spout opening, or a delivery device with a pump mechanism, a small sponge or a roll-on-mechanism is provided at the perfume container. The delivery device is usually covered with and protected by means of a screw cap or plug-in cap.

A known spraying device (U.S. Pat. No. 1,880,373) is constructed pin-shaped and has at one end a spray head, which can be activated by means of pump device that is provided at the pin body outside of a cap covering the spray head. The cap is a conventional screw cap with a narrow clip known from fountain pens.

From the FR-A-2 522 283, a refillable perfume dispenser is known, the perfume container of which is a glass tube accommodated in a sleeve, which consists preferably of metal. At its one end, the glass tube is closed off by means of a pump mechanism and at its other end by a removable seal. A covering cap is not provided.

The U.S. Pat. No. 3,078,497 discloses an apparatus, which is also suitable for delivering perfume. The perfume container is made from metal. It is closed off at its open end by means of a connector, which consists of plastic and on which a cap covering the delivery device can be placed.

Finally, the WO 90/07430 discloses a perfume dispenser, for which an ampule, containing perfume, is accommodated in a cylindrical housing. A roll-on mechanism is screwed into the open end of the housing. When the roll-on mechanism is screwed into the open end of the housing, a pointed, inwardly directed projection taps the ampule accommodated in the housing. A covering cap, covering the roll-on mechanism, is held by means of a plug-in connection on the housing of the perfume dispenser.

Compared to this state of the art, the object of the present invention is based on providing a perfume dispenser, which can be produced inexpensively, is reliable in use and advantageously is suitable as an advertising vehicle. In particular, the inventive perfume dispenser shall be devised so that, on the one hand, it has sufficient areas for affixing advertising and, on the other, it is willingly taken along and used by the user, so that the advertising, affixed to the perfume dispenser, can also be perceived by third parties. According to the second aspect, the inventive perfume dispenser shall be distinguished by special handiness and easy manageability. At the same time, in accordance with the first-named aspect, the available advertising surfaces must not be too small. Furthermore, it should have an attractive design.

Pursuant to the present invention, this objective is accomplished by a perfume dispenser with the following characteristics:

- The perfume container, produced form glass tubing, has an elongated shape.
- A delivery device is provided on one side of the perfume dispenser.
- A covering cap, preferably of plastic, covers at least the part of the delivery device protruding from the perfume container.
- A clip is connected with the covering cap or with the end of the perfume container having the delivery device and serves as an outwardly directed advertising surface as well as for clamping the perfume dispenser.
- A plug-in connection is provided between the covering cap and a metal mounting of the delivery device, which holder connects said delivery device with the perfume container.

Because the perfume container is produced from glass tubing, the manufacturer costs are particularly low; pieces, corresponding in length to the container, are cut off from long glass tubing, sealed at one end by fusing and closed up at the other end with the delivery device. Moreover, it may be advantageous to protect the perfume container, which is made from glass tubing, from bursting with a protective coating, for example, tough coating powders.

In practice, the plug-in connection between the covering cap and the perfume container made from glass is a problem, since the glass container, in contrast to the plastic parts, cannot be produced with correspondingly narrow tolerances. Because the covering cap, generally made from plastic, can be slipped onto a metal mounting of the delivery device, for example, onto a screw cap of the delivery device that is present anyhow, it is avoided that the cap is seated too tight or too loose. A further possibility for compensating for the tolerances of the aforementioned plug-in connection consists therein that the covering cap has a plug-in opening, the edge region of which is provided with at least one slot.

Owing to the fact that the whole of the delivery device is covered towards the outside by the cap when the perfume pen is not in use, any unintentional emptying of the perfume container is reliably avoided.

To improve the seating of the cap in the region of the plug-in connection, it may be appropriate to provide the inner sleeve with inwardly projecting, longitudinally extending ribs, which preferably have elastic properties; thin-walled hollow ribs are also suitable.

The inventive perfume dispenser preferably has a cylindrical shape, which is similar to that particularly of a pencil. The clip, provided at the covering cap, is broad and is suitable particularly for attaching advertising, jewelry or the like, since it is also visible when the perfume dispenser is inserted above the edge of a pocket, from which only the clip protrudes. The perfume container itself can also serve as an advertising surface, particularly for an advertiser, differing from that on the clip. This permits ideal joint advertising of two partners, for example, a perfume manufacturer and an automobile manufacturer. The inventive design furthermore contributes to the perfume dispenser being particularly convenient, that is, it can, held by the clip, be worn like a pencil in a jacket or a shirt pocket, without dispensing. In ladies handbags, the clip serves to secure the position of the perfume dispenser. Consequently it is readily and regularly carried along and used by the user. In the inventive design of the perfume dispenser as a "perfume-pen," there is moreover a certain "camouflage," which makes it easier for some persons to decide to carry a perfume dispenser. The inventive perfume pen thus represents, so to say, a cap with an advertising surface and a supply of perfume.

Due to the longitudinal design of the, for example, cylindrical perfume container, the latter can have a relatively large capacity without having a diameter that is too large. Due to the elongated cylindrical shape of the perfume container and the cylindrical construction of the covering cap, the perfume dispenser as a whole has an attractive, slender shape. This impression is supported by making the perfume dispenser from glass, optionally with a plastic covering. Different, known systems come into consideration as delivery device. For example, a simple spout opening may be provided in the perfume container. Preferred embodiments of the inventive perfume dispenser, however, have a delivery device, which comprises a pump mechanism, a small sponge or a roll-on mechanism in the case of a preferred embodiment, the delivery device, which has a pump mechanism, is screwed onto the perfume container, so that the latter can be refilled. For the pump mechanism, which is connected with the perfume container by crimping or folding, a filler opening, which can be closed off, is advisably fitted at the other end of the perfume container.

Usually, the clip is molded in one piece with the covering cap. However, it is advantageous if the clip and the covering cap initially are produced separately from one another and both parts have elements of a hook or screw connection, so that the clip can be fastened later on by means of the hook or screw connection to the covering cap. This is particularly advantageous in view of the fact that the clip serves as an advertising vehicle and, accordingly, the particular advertising desired can be affixed to the corresponding perfume dispenser in a particularly simple manner. By these means and at only a slight cost for manufacturing tools, an individual clip can be used for advertising purposes in that it is connected with a standardized cap. The connection between the cap and the clip is such, that it can be undone again only with difficulty, that is, with the employment of a large force or by means of a tool. A separate holding device, which is connected to the outside of the covering cap and engages either the side or the end of the cap, can advantageously function as such a connection. Likewise, under the aspect that the clip functions as advertising vehicle, the latter preferably has a flat widened section, for example, in the form of a circle, an ellipse, a rectangle with rounded corners, or the like; the shape of the widened section can also correspond to a known company logo. In a preferred embodiment, the widened section of the clip or the clip itself has a width, which at the very least is not significantly less than the diameter of the cap. In a further refinement, the clip can have on its exterior a countersunk supporting surface for an advertising element or a coating serving as decoration. Particularly with short perfume containers, for example, in the case of sample vials, the clip can extend essentially over the whole length of the container. The clip can also be contoured or configured or broadened as a company symbol, for example, in the shape of the bottle, with which the perfume, filled into the perfume container, is to be sold.

The covering cap is fastened preferably simply by slipping it onto the perfume container. For this purpose, a locking connection is provided between the covering cap and the perfume container, that is, the covering cap and the perfume container have corresponding locking elements, which hold the covering cap in place on the perfume container. Alternatively, a screw connection is provided at the perfume container and the cap.

A particularly valuable embodiment of the covering plate may consist therein that the latter is constructed in two parts, namely, of an outer sleeve, which increases the optical effect, and a preferably elastically deformable inner sleeve, which functions as the plug-in connection. The outer sleeve consists preferably of metal and the inner sleeve of a plastic, for example, of propylene.

For the assembly of the two-part cap, the external sleeve is advantageously planned to be cylindrical, while the internal sleeve tapers slightly starting from the plug-in opening; as a result, the two parts can be wedged together simply by being squeezed. Due to the space between the two sleeves, the inner sleeve can be expanded radially when it is slipped onto the perfume container.

The cross-section of the perfume container and of the covering cap preferably is round, polygonal or pentagonal; in the latter case, there are, compared to a circular cross-section, further sufficiently large areas suitable for advertising purposes.

In the following, the invention is described in greater detail by means of the drawing, in which FIG. 1 shows a side view of an inventive perfume dispenser with the covering cap in place, FIG. 1*a* shows the covering cap of the perfume dispenser of FIG. 1 in a representation turned through 90°, FIGS. 2 and 3 show a perfume dispenser, the delivery devices of which in each case comprise a pump mechanism, with the covering hood removed, FIG. 4 shows a perfume dispenser with a spout opening and the covering cap removed, FIG. 5 shows a perfume dispenser, the delivery device of which comprises a roll-on mechanism, with the covering cap removed and FIGS. 6 and 7 each show a further embodiment of a covering cap.

The perfume dispenser of FIGS. 1 and la comprises a perfume container 1, which has the shape of an elongated cylinder. The covering cap 2 is placed upon the perfume container 1. Said cap 2 also has a slender, cylindrical shape and a diameter, which is only slightly larger than that of the perfume container 1. A clip 4 is integrally molded to the upper end 3 of the covering cap. This clip 4 ends in a broadened section 5, which has the shape of a circular disk.

According to FIG. 2, a delivery device 6, which comprises a pump mechanism that is known as such, is placed upon the perfume container 1. The appropriate delivery device is connected with the perfume container by cushioning along the seam 7. The pushbutton 8 with the outlet nozzle 9 of the known pump mechanism can be recognized.

The perfume dispenser of FIG. 3 differs from that of FIG. 2 owing to the fact that the delivery device, which also has a pump mechanism, is screwed onto the perfume container 1. For this purpose, the perfume container has at its upper end an external thread and the delivery device 6 has a screw cap 10 with a corresponding internal thread. The perfume container of FIG. 3 is constructed from glass. The pump element 11 and the suction tube 12 can be recognized through the walls of the container.

The perfume container of FIG. 4 is an elongated hollow cylinder, at the upper end of which a pouring spout 13 is disposed, through which the perfume in the container can be delivered.

The perfume container 1, shown in FIG. 5, is provided at its upper end with a delivery device 6, which comprises a roll-on mechanism. The roll-on mechanism, as such, is known and has a delivery ball 14, which is mounted in a spherical holder 15. The delivery device 6 with the roll-on mechanism is connected with the perfume container 1 by cushioning along the seam 7.

FIG. 6 shows an axial section through a covering cap 2, which is open at the top to accommodate a clip ring 20 of the clip 4. The clip ring 20 is located on the inside of a lid 21, which is constructed in one piece with the clip 4. On the inside of the sleeve 22 of the covering cap 2, upper longitudinal ribs 23 are molded, which serve to stiffen the cap 2; close to the lower edge 24 of the sleeve 22, short longitudinal ribs 25 are provided, which define the seat of the covering cap 2 on the perfume container 1. Within the covering cap 2, the upper end of the perfume container 1 with the delivery device 6 is drawn with thin lines. A threaded screw cap 10 holds the delivery device 6 to the container 1, as in FIG. 3. The lower ends of the upper longitudinal ribs 23 are seated on the upper edge 26 of the screw cap 10 of the delivery device 6, that is, they define the locked position of the covering cap 2. By these means, it is ensured that the operating head of the pump is always in the maximum extended closed position. In addition to or instead of the short longitudinal ribs 25, the lower edge of the inner sleeve 28 can be expanded through the agency of a slit 33, which is drawn by a broken line.

Figure 7:
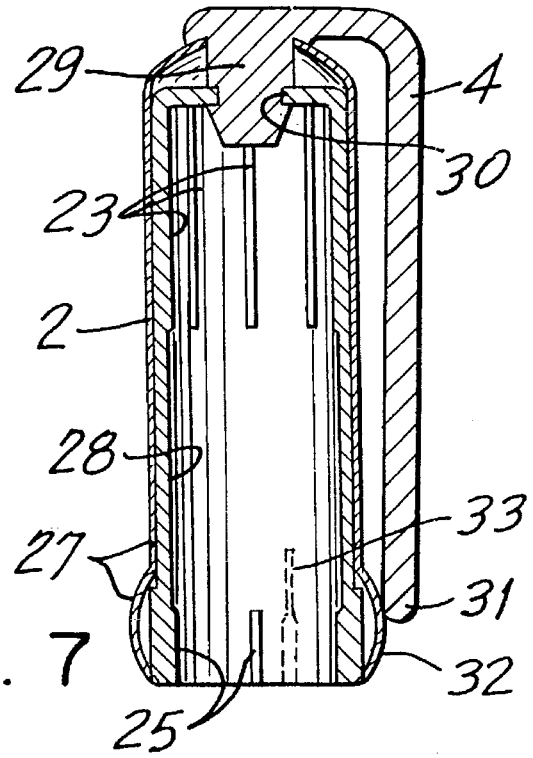

FIG. 7 shows a different embodiment of the covering cap 2, which consists here of a metallic outer sleeve 27 and a plastic inner sleeve 28. As in FIG. 6, the latter has upper longitudinal ribs 23 and short longitudinal ribs 25 at the bottom. At the top, the clip 4 has a pin 29, which enters the outer sleeve through an opening in the outer sleeve 27 and is anchored in a front-end borehole 30 of the inner sleeve 28 in the form of a Schapp connection. The lower end 31 of the clip 4 comes to rest against a lower edge expansion 32 of the outer sleeve 27.

Within the scope of the invention, it is immaterial whether the clip is attached to the front or the side of the covering cap; the clip can also be mounted by means of a fastening ring to the top of the covering cap or directly to the perfume container.

I claim:

1. A perfume dispenser, comprising:

a perfume container (1), made from glass and having one end and an opposite end, with an elongated shape between said ends;

a delivery device (6) provided on said one end of said perfume container, said delivery device including a metal holder connecting said delivery device with said perfume container;

a covering cap (2) covering at least a part of said delivery device protruding from said one end of said perfume container, ribs protruding inwardly from an inner surface of said covering cap and extending longitudinally toward said opposite end;

a clip (4) connected with one of said covering cap and said one end of said perfume container having said delivery device, said clip being functional as an outwardly directed advertising surface, and for clamping said perfume dispenser to an external object, a plug-in connection being provided between said covering cap and said metal holder of said delivery device.

2. A perfume dispenser, comprising:

a perfume container (1), made from glass and having one end and an opposite end with an elongated shape between said ends;

a delivery device (6) provided on said one end of said perfume container, said delivery device including a metal holder connecting said delivery device with said perfume container;

a covering cap (2) covering at least a part of said delivery device protruding from said one end of said perfume container, a plug-in connection being provided between said covering cap and said metal holder of said delivery device;

a clip (4) connected with one of said covering cap and said one end of said perfume container having said delivery device, said clip being functional as an outwardly directed advertising surface, and for clamping said perfume dispenser to an external object, wherein said plug-in connection includes said covering cap (2), a plug-in opening in the covering cap, and an edge region of said opening being provided with at least one slot (33).

3. A perfume dispenser, comprising:

a perfume container (1), made from glass and having one end and an opposite end with an elongated shape between said ends;

a delivery device (6) provided on said one end of said perfume container, said delivery device including a metal holder connecting said delivery device with said perfume container;

a covering cap (2) covering at least a part of said delivery device protruding from said one end of said perfume container, a plug-in connection being provided between said covering cap and said metal holder of said delivery device;

a clip (4) connected with one of said covering cap and said one end of said perfume container having said delivery device, said clip being functional as an outwardly directed advertising surface, and for clamping said perfume dispenser to an external object, wherein in said plug-in connection said covering cap (2) includes an external sleeve (27) and an internal sleeve (28).

4. The perfume dispenser of claim 1, wherein the delivery device (6) includes a pump mechanism.

5. The perfume dispenser of claim 4, wherein the delivery device (6) is screwed to the perfume container (1) at said metal holder.

6. The perfume dispenser of claim 1, wherein said clip (4) is fastened to said cap (2) by a holding element, said clip adjoining an external shape of the covering cap.

7. The perfume dispenser of claim 6, wherein the clip (4) and the holding element are removably fastened to said covering cap, whereby clips may be exchanged.

8. The perfume dispenser of claim 3, wherein the external sleeve (27) is metal and the internal sleeve is plastic.

9. The perfume dispenser of claim 8, wherein the inner-sleeve includes polypropylene.

10. The perfume dispenser of claim 3, wherein the internal sleeve (28) includes ribs (23, 25) protruding inward and extending in a longitudinal direction between said one end and said opposite end.

11. The perfume dispenser of claim 1, wherein the clip (4) is one piece with the covering cap (2).

* * * * *